United States Patent [19]

Rhoads

[11] Patent Number: 4,524,731

[45] Date of Patent: Jun. 25, 1985

[54] HYDRAULIC VALVE LIFTER WITH CONTINUOUS VOID

[76] Inventor: Jack L. Rhoads, P.O. Box 830, Taylor, Ariz. 85939

[21] Appl. No.: 523,119

[22] Filed: Aug. 15, 1983

[51] Int. Cl.[3] ..... F01L 1/24

[52] U.S. Cl. ..... 123/90.57; 123/90.55; 29/156.7 B

[58] Field of Search ..... 29/156.7 R, 156.7 B; 123/90.55, 90.57, 90.58

[56] References Cited

U.S. PATENT DOCUMENTS

| | | | |
|---|---|---|---|
| 3,291,107 | 12/1966 | Cornell | 123/90.55 X |
| 3,304,925 | 2/1967 | Rhoads | 123/90.55 |
| 3,670,707 | 6/1972 | Guido | 123/90.57 |
| 3,921,609 | 11/1975 | Rhoads | 123/90.57 X |

FOREIGN PATENT DOCUMENTS

| | | | |
|---|---|---|---|
| 2010562 | 9/1971 | Fed. Rep. of Germany | 123/90.57 |

*Primary Examiner*—William R. Cline

*Assistant Examiner*—Peggy A. Neils

*Attorney, Agent, or Firm*—Ralph S. Branscomb

[57] ABSTRACT

A hydraulic valve lifter for use in high performance engines to reduce valve overlap at low operating speeds utilizes a restricted oil bleed passageway leading from the lifter pressure chamber to externally of the lifter to permit oil to bleed from the pressure chamber, preventing the lifter from pumping up to a fully solid condition at low operating speeds; the passageway, however, is sufficiently narrowed to pass an insignificant volume of oil therethrough at higher speeds. This passageway, previously defined as an external flat ground partway up the lifter plunger, is, according to the instant disclosure, ground fully up to the top of the plunger. This permits the plungers to be ground much more easily than before, inasmuch as they can be axially aligned on a magnetic chuck, or the equivalent, with the flat or groove which defines the bleed passageway cut in a single stroke, or several unhalting strokes, across an entire set of the lifter plungers.

3 Claims, 11 Drawing Figures

HYDRAULIC VALVE LIFTER WITH CONTINUOUS VOID

BACKGROUND AND SUMMARY OF THE INVENTION

The invention pertains to the timing of the intake and exhaust valves of internal combustion engines, and more particularly to varying the timing such that the valves remain open a longer portion of the engine's operating cycle at higher RPM than at lower RPM. The invention is directed particularly to, but not exclusively to, high performance engines having a modified camshaft.

When an engine is cammed for more power, its ability to breathe is effectively increased by opening the valves wider and holding them open longer. Keeping them open longer is known as increasing the duration of the cam. Theoretically, the exhaust valve of each cylinder opens when the piston reaches bottom dead center of the power stroke and remains open as the piston rises to top dead center on the exhaust stroke. At this point, the intake valve opens and the exhaust valve closes. This is, generally speaking, how the valves are timed on a stock engine.

In order to extend the total duration of the valves, the exhaust value must open before the piston reaches bottom dead center and close after the piston reaches top dead center, and the intake valve opens before the piston reaches top dead center and closes after reaching bottom dead center. This gets into a situation known as overlap: the intake valve opens before the exhaust valve is fully closed, producing a period in which both valves are open simultaneously.

At high RPM, despite the overlap, the increase in the ability of the engine to breath increases engine power. However, at low RPM, just the opposite is true, and the more radically varied the cam is, the greater is the overlap period, and the greater the power loss at low RPM. A car modified with a radical cam is hard to start, idles very roughly, and lacks low speed power.

This problem is addressed in U.S. Pat. No. 3,921,609, issued to the instant inventor's father on Nov. 25, 1975. That invention, in turn, was an improvement over U.S. Pat. No. 3,304,925, also invented by the instant applicant's father.

According to the first patent referenced above, a small flat was ground on the outer surface of the plunger that is internal of the lifter body. This flat had the effect of communicating continuously between the high pressure chamber in the bottom of the lifter which becomes pressurized and raises up to lift the valve pushrod higher, which opens the valve longer. The flat acts as a bleed passageway. The cross sectional area of the passageway defined between the flat and the cylindrical lifter body in which the plunger slides is very restricted. Because of the exponential increase of the resistance to fluids that an orifice offers at increased flow rates, the passageway adequately bleeds the lifter pressure chamber at low RPM, but is substantially ineffective at high RPM.

This has the effect of reducing valve duration significantly at low RPM while permitting normal hydraulic pumping up of the lifter at high RPM to achieve the enlarged lift and duration that the modified camshaft was installed to provide.

The flat that was ground on the lifter plunger according to the above-referenced patent disclosure did not extend the full length of the plunger. It only extended from the bottom end in communication with the lifter pressure chamber to an annular channel midway up the plunger required for oil circulation. This channel communicates with oil under pressure as provided by the oil pump, and thus it would seem logical that to grind the flat the remaining distance, all the way to the top of the plunger, would have a detrimental effect on oil pressure. A flat so ground would directly communicate between the pressurized oil in an oil gallery, and the sump area of the engine which is substantially at atmospheric pressure.

Because the flat could not be ground all the way up each plunger, each plunger had to be individually ground. The operator would have to be very careful to stop the grinder, which ordinarily would be an abrasive wheel on a surface grinder, from passing beyond the annular oil port in the plunger. Because of this, the labor intensity of reducing the modified plungers was considerable. The instant inventor has been making and selling valve lifters according to the above-referenced patent for ten years. Each and every valve lifter produced during that ten-year period was individually ground, with the flat stopping at the annular channel. During this time, it did not occur to the inventor that he could grind the flat all the way up without losing oil pressure. This is quite significant, because the inventor makes his living selling these lifters with the flat ground on the side of the plunger. He is an expert on modified lifters, and for ten years it was not obvious to him to change his manufacturing process by grinding the flat across the entire length of the plunger.

Before making the new plunger with the full-length slot or flat, the inventor's dubious opinion was corroborated by mechanics and engineers who also felt that it was essential to have a positive seal between the oil gallery and the engine's sump around the top portion of the lifter plunger. However, the inventor's sales had grown over the years to the point where the labor involved in producing the plungers the old way became a burden. In order to be able to carry on, the inventor tried continuing the passageway over the entire side of the lifter. To everyone's tremendous surprise, the lifters worked just as well with the passageway all the way up as the passageway stopping at midsection of the lifter.

Although structurally what the inventor achieved might not appear significant to one not involved in the business on a day-to-day basis, the effect of the new-style passageway on the inventor's business operation is tremendous. Rather than being required to individually grind each plunger, an entire set of sixteen is coaxially aligned on the magnetic chuck of a surface grinder, and the grinding wheel modifies the entire set at once. He can produce hundreds of modified lifters in the time previously required to produce dozens.

And, just as important, the new production technique does not cause a deterioration of lifter operation or loss of oil pressure at all. This is very important because the Rhoads lifter, as it is known in the marketplace, has achieved a reputation for quality that has been developed over years and this good will could not be jeopardized, even though substantial labor might be saved by producing a lifter of decreased performance.

DETAILED DESCRIPTION OF THE PREFERRED EMBODIMENTS

Figure 11:
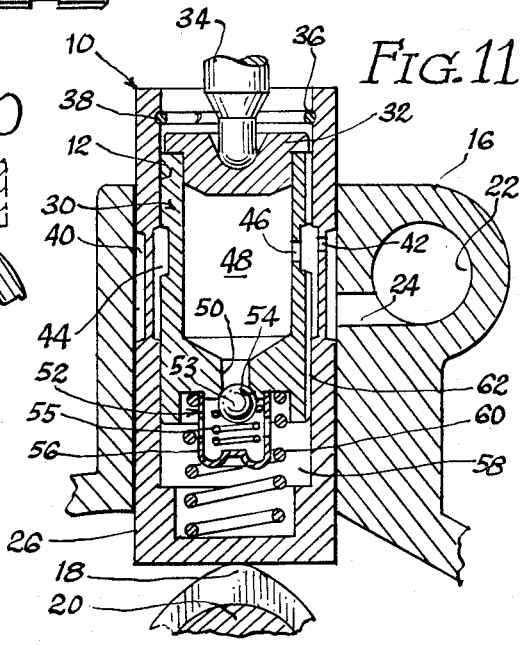
FIG. 11 is a section taken through the lifter as it appears in place in an engine.

The overall assembly and operation of the hydraulic valve lifter can best be understood by reference to FIG. 11. Valve lifter 10 is axially and slidably seated in a bore 12 in a portion in the engine block casting 16. A single valve is shown, there being one lifter for each valve in the engine, with each lifter operated by a lobe 18 on a camshaft 20. In the head 16 is an oil gallery 22 with a supply duct 24 leading to bore 12 to supply oil to the lifter from the pressure side of the engine oil system.

Valve lifter 10 comprises a cylindrical body 26 having a closed lower end 28 and axially slidable within the body is a hollow cylindrical plunger 30. In the upper end of plunger 30 is cup 32 in which is seated the end of a push rod 34, the push rod being coupled to a conventional rocker arm and valve, not shown. Plunger 30 is retained by a snap ring 36 in a groove 38 which is in the upper end of body 26. Body 26 has an external peripheral collecting channel 40 which registers with supply duct 24. A port 42 communicates from channel 40 to the interior of body 26 and plunger 30 has a peripheral annular channel 44 which registers with port 42 at all times. From channel 44 a port 46 leads to the interior of plunger 30, so that oil is continuously being admitted into the inner chamber 48 of plunger from the oil gallery regardless of any rotational or axial displacement experienced by the lifter components.

At the lower end of plunger 30 is a small outlet 50, the lower end of which is closed by a check valve 52 having a sealing element 53 held in place against the seating 54 by a seating spring 55, the spring and valve being held in place by a perforated retaining cage 56. The space between plungers 30 and the lower end of body 26 comprises the plunger pressure chamber 58, and in this chamber is a return spring 60 which biases the plunger upwardly out of the body, until stopped by the snap ring 36. In normal assembly, the plunger 30 is pressed down against return spring 60 by the push rod 34, which is loaded by the much stronger valve spring, not shown.

The structure thus far described is conventional and representative of hydraulic valve lifters, which may vary somewhat in porting, plunger design, and check valve arrangements. In operation, the plunger chamber 48 receives oil under pressure from the oil pump via the oil gallery and supply duct, the oil being forced down through the check valve 52 and pressure chamber 58, thereby causing the plunger to rise and tighten the valve train. With no return leakage or only that which may occur through the normal sliding clearance between the plunger 30 and the body 26, the oil in chamber 58 is pumped rapidly and the lifter becomes effectively solid, or in a fully pumped-up position.

Figure 1:
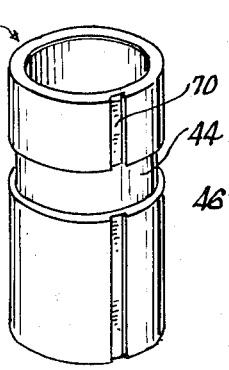
FIG. 1 is a perspective view of the plunger having a groove running its entire length according to the instant invention.
Figure 2:
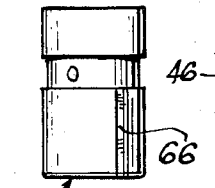
FIG. 2 illustrates the groove which terminates at the annular channel in the plunger.
Figure 3:
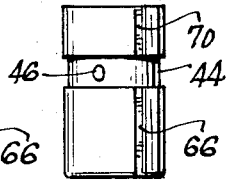
FIG. 3 is a side elevation view of the lifter of FIG. 1.
Figure 4:
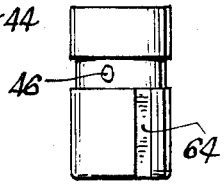
FIG. 4 illustrates the prior art, comprising a flat ground on the lower portion of a plunger.
Figure 5:
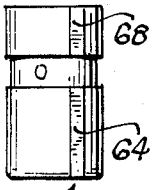
PRIOR ART FIG. 5
FIG. 5 illustrates a second embodiment of the invention wherein a flat, rather than a groove, runs the entire length of the plunger.
Figure 6:
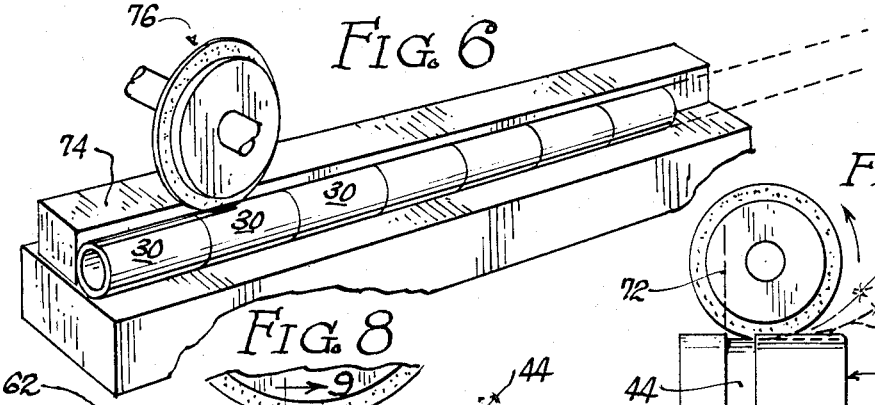
FIG. 6 is a diagrammatic perspective illustrating the production of the modified plunger.

The action which was achieved by the inventor's father's inventions disclosed in the above-referenced patent is achieved by providing a continuously open bleed passageway communicating between the pressure chamber 58 and the annular channel 44, so that there is a continuous bleeding of pressure from the lifter pressure chamber. The passageway is shown in two embodiments in the instant disclosure. In one instance, the bleed passageway 62 is defined as a flat 64 as in the prior art. In a second embodiment, the flat is replaced by a groove 66, shown in FIGS. 2 and 3.

In operation, with either of these embodiments, at lower engine speeds the lifter will attempt to pump up. However, since oil leaks through the bleed passageway 62, the pumping up will be retarded. As higher engine speeds are achieved, the resistance of the bleed passageway effectively increases since it is too narrow to pass oil in quantity due to the exponential resistance of fluid passageways as a function of increased pressure gradient and flow velocity. The net result is a gradual pumping up of the lifter with increased engine speeds, until finally the lifter becomes effectively solid and at a fully pumped up position at high speeds.

It has been shown that the flat version of the passageway 64 works well at a depth of about 0.0025 inch. The flat version of the passageway is fairly practical when the plungers are ground individually. However, according to the manufacturing technique of the instant disclosure, the groove 66, being about 0.020 inches wide and 0.0045 inches deep, is more practical. This is true because when grinding the groove, if the diameters of the plungers differ by about one thousandth of an inch, the grinding wheel will thus produce flats or grooves that vary by that amount from one plunger to the next. This amount of variance is not significant when cutting the groove because the cross sectional tolerance remains the same. However, when grinding the flats, one thousandth can make a great difference in the cross sectional area of the effective bleed passageway.

The discussion to this point covers the operation of hydraulic valve lifters, and then more specifically the operation of the Rhoads lifter as set forth in U.S. Pat. No. 3,921,609. The improvements in the instant invention are shown at 68 and 70, representing, respectively, continuations of the flat and the groove over the entire length of the plunger. Although this improvement is extremely simple, its impact is enormous on the valve modification business.

Figure 7:
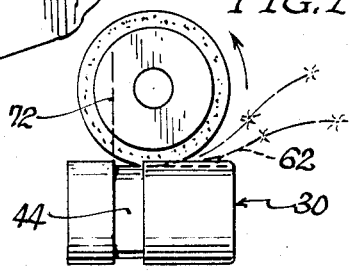
FIG. 7 is an elevation view illustrating plunger modification according to the prior art.
Figure 8:
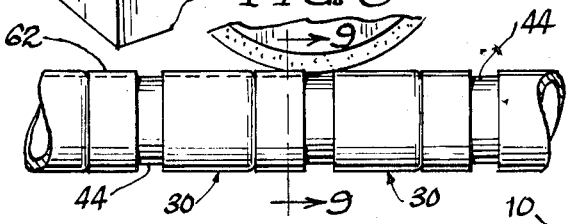
PRIOR ART FIG. 8
FIG. 8 is a side elevation view illustrating the production technique of FIG. 6.
Figure 9:
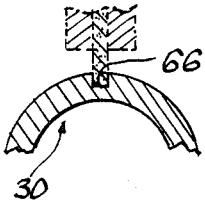
FIG. 9 is a section taken along line 9—9 of FIG. 8.
Figure 10:
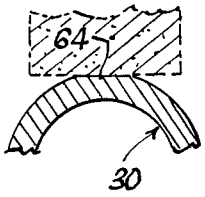
FIG. 10 is a section similar to FIG. 9, but showing a flat rather than a groove being ground onto the plunger.

FIG. 7 illustrates the manner in which the plungers formerly had to be ground. The line 72 defines the point beyond which the grinder must not move in order to maintain the cylindrical integrity of the upper portion of the plunger. As stated in the background and summary of the invention, maintenance of this integrity was formerly considered to be crucial for the proper operation of the engine. However, whether the passageway be the flat 64 or the groove 66, it is not hard to imagine how time-consuming the manufacturing process would be according to the technique indicated in FIG. 7.

By contrast, the inventor/manufacturer can now line up an entire set of sixteen plungers, aligned by alignment bar 74 on a magnetic chuck, and in one or several sweeps of the wheel, properly groove or flat the entire set. Thus, the total time required is less than 25% of that required by the prior art technique.

The significance of this can be appreciated by a quick analysis of the inventor's business. The production portion of the business involves almost 100% labor costs. There are no parts added as the inventor receives the lifters straight from the manufacturer in their final form except for the bleed passageway. Thus, the only production cost other than labor is the occasional maintenance of the surface grinder and eventual replacement of the grinder wheels.

So clearly, the invention does more than shave 5% or 10% percent off production costs, but rather slashes them by more than 75% percent. Thus, although the invention is simple, it has eluded those experts in the field to this point, and the results it produces are not only startling, but of enormous importance to the industry, and particularly to Rhoads Lifters, Inc., the manufacturer of the modified lifter.

The various arrangements described herein are adaptable to a variety of engines and can be incorporated into many existing types of valve lifters without requiring any changes in the engine. Existing lifters already in use can be removed and modified in accordance with this disclosure. It is understood that minor variations from the form of the invention disclosed herein may be made without departure from the spirit and scope of the invention, and that the specification and drawings are considered to be as merely illustrative rather than limiting.

I claim:

1. In a hydraulic valve lifter having a hollow cylindrical body with a closed lower end for engagement with a cam; a hollow cylindrical plunger axially slidable in said body and enclosing a pressure chamber in the lower end of the body; an external collecting channel in said body to receive oil from a pressurized source; a port opening into said body from said channel; a port in said plunger communicating with said first-mentioned port to admit into the plunger; and a one-way valve in said plunger opening into said pressure chamber; an improvement comprising:

(a) an oil bleed passageway defined in the exterior of said plunger extending the full length of said plunger providing continuous communication therethrough from one end of said plunger to the other when same is seated in said body;

(b) said bleed passageway comprising a groove and being dimensioned and cross-sectioned to be inadequate to sustain oil bleed beyond a pre-determined volumetric flow at high engine speeds.

2. The structure according to claim 1 wherein said groove is on the order of 0.020 inches wide and 0.0045 inches deep.

3. The structure according to claim 1 wherein said groove is straight and parallel to the plunger axis and is completely unobstructed by other plunger structure from one end of said plunger to the other to enable same to be ground by the complete stroke of a grinding wheel from one end of the plunger past the other end.

* * * * *